US012031240B2

(12) United States Patent
Horihata et al.

(10) Patent No.: US 12,031,240 B2
(45) Date of Patent: Jul. 9, 2024

(54) FIBER FOR ARTIFICIAL HAIR AND HEAD ACCESSORY PRODUCT

(71) Applicant: DENKA COMPANY LIMITED, Tokyo (JP)

(72) Inventors: Atsushi Horihata, Kamakura (JP); Atsushi Takei, Kamakura (JP)

(73) Assignee: DENKA COMPANY LIMITED, Tokyo (JP)

( * ) Notice: Subject to any disclaimer, the term of this patent is extended or adjusted under 35 U.S.C. 154(b) by 124 days.

(21) Appl. No.: 17/296,280

(22) PCT Filed: Nov. 15, 2019

(86) PCT No.: PCT/JP2019/044921
§ 371 (c)(1),
(2) Date: May 24, 2021

(87) PCT Pub. No.: WO2020/110782
PCT Pub. Date: Jun. 4, 2020

(65) Prior Publication Data

US 2022/0018041 A1 Jan. 20, 2022

(30) Foreign Application Priority Data

Nov. 29, 2018 (JP) ..... 2018-224036

(51) Int. Cl.
*D01F 6/48* (2006.01)
*A41G 3/00* (2006.01)

(52) U.S. Cl.
CPC ..... *D01F 6/48* (2013.01); *A41G 3/00* (2013.01); *D10B 2321/041* (2013.01); *D10B 2401/061* (2013.01); *D10B 2503/08* (2013.01)

(58) Field of Classification Search
CPC ..... D01F 6/48; D01F 6/10; D10B 2321/041; D10B 2503/08; A41G 3/00; A41G 3/0083
See application file for complete search history.

(56) References Cited

U.S. PATENT DOCUMENTS 7,452,596 B2 11/2008 Adachi
2008/0139705 A1 6/2008 Adachi
(Continued)

FOREIGN PATENT DOCUMENTS

CN 103088456 A 5/2013
JP H02-245049 A 9/1990
(Continued)

OTHER PUBLICATIONS

Machine Translation of JP2003328222A (Year: 2003).*
(Continued)

*Primary Examiner* — Jenna N Chandhok
(74) *Attorney, Agent, or Firm* — Oliff PLC

(57) ABSTRACT

A fiber for artificial hair formed of a polyvinyl chloride-based resin composition. The fiber for artificial hair has a value X1 of a loss tangent tans at 70° C. of 0.06 or more and 0.12 or less, when dynamic viscoelasticity is measured under the following conditions, and has a peak in a temperature range of 90° C. or higher and 110° C. or lower. (Dynamic viscoelasticity measurement conditions) The measurement is performed by sandwiching a bundle of 40 fibers for artificial hair that are arranged at a heating rate of 4° C./min and a frequency of 1 Hz.

6 Claims, 1 Drawing Sheet

(56) References Cited

U.S. PATENT DOCUMENTS

| | | | | |
|---|---|---|---|---|
| 2008/0210250 | A1 | 9/2008 | Horihata et al. | |
| 2013/0298924 | A1* | 11/2013 | Hashimoto | A41G 5/004 525/190 |

FOREIGN PATENT DOCUMENTS

| | | | | |
|---|---|---|---|---|
| JP | H08-296115 | A | | 11/1996 |
| JP | H11-50330 | A | * | 2/1999 |
| JP | H11-050330 | A | | 2/1999 |
| JP | 2000-191871 | A | | 7/2000 |
| JP | 2003-328222 | A | | 11/2003 |
| JP | 2007-146306 | A | | 6/2007 |
| JP | 2008-31560 | A | | 2/2008 |
| KR | 10-2008-0016792 | A | | 2/2008 |
| WO | 2006/093009 | A1 | | 9/2006 |
| WO | 2012/046748 | A1 | | 4/2012 |
| WO | 2017/221773 | A1 | | 12/2017 |

OTHER PUBLICATIONS

Machine Translation of JPH11-50330A (Year: 1999).*

Jan. 7, 2020 International Search Report issued in International Patent Application No. PCT/JP2019/044921.

Oct. 19, 2022 Office Action issued in Chinese Patent Application No. 201980077249.3.

Nov. 27, 2023 Office Action issued in Korean Application No. 2021-7015932.

Dec. 12, 2023 Office Action issued in Japanese Application No. 2020-558353.

* cited by examiner (a)
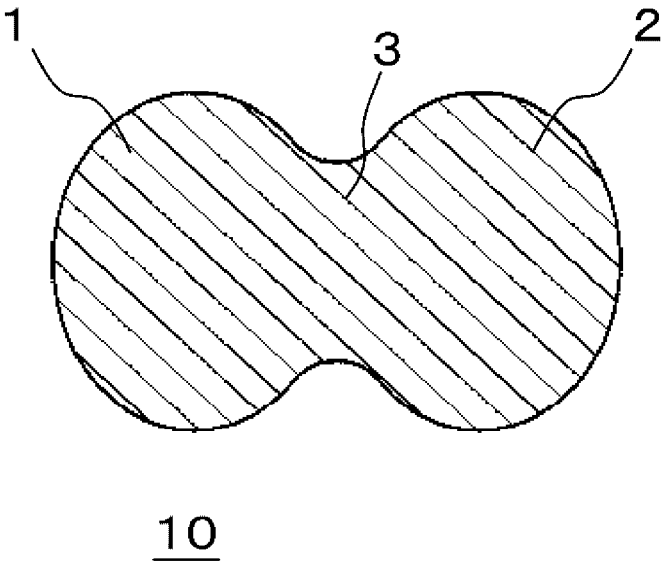
(b)
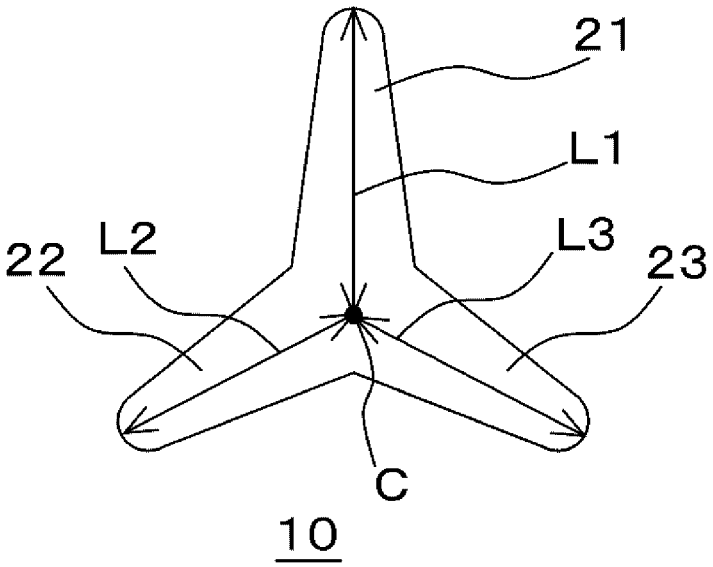

FIBER FOR ARTIFICIAL HAIR AND HEAD ACCESSORY PRODUCT

TECHNICAL FIELD

The present invention relates to a fiber for artificial hair and a head accessory product.

BACKGROUND ART

A polyvinyl chloride-based fiber has excellent strength, elongation, and the like, and is often used as a fiber for artificial hair constituting a head accessory product.

Patent Document 1 discloses a polyvinyl chloride-based fiber for artificial hair made of a resin composition containing a vinyl chloride-based resin and a crosslinked polyvinyl chloride-based resin having a defined viscosity average molecular weight, and having a cross-sectional shape formed by combining a circle, a parabola, or an ellipse.

RELATED DOCUMENT

Patent Document

[Patent Document 1] International Publication No. WO2006-093009

SUMMARY OF THE INVENTION

Technical Problem

The characteristics required for a fiber for artificial hair are a good tactile sensation when touched with a finger and a good appearance that does not make a person visually uncomfortable due to glare caused by light reflection. The present inventors examined the tactile sensation and appearance of a fiber for artificial hair, and it was clarified that in a case where the tactile sensation when touched with a finger becomes good, the glare becomes stronger and the appearance becomes unfavorable. That is, according to the examination by the present inventors, it was clarified that there is a trade-off relationship between good tactile sensation and good appearance in a fiber for artificial hair, and it is difficult to improve these characteristics in a well-balanced manner.

Therefore, an object of the present invention is to provide a fiber for artificial hair that exhibits a good tactile sensation and an appearance in which glare is suppressed in a well-balanced manner.

Solution to Problem

According to the present invention, there is provided a fiber for artificial hair formed of a polyvinyl chloride-based resin composition, in which the fiber has a value X1 of a loss tangent tan δ at 70° C. of 0.06 or more and 0.12 or less, when dynamic viscoelasticity is measured under the following conditions, and has a peak in a temperature range of 90° C. or higher and 110° C. or lower.

(Dynamic Viscoelasticity Measurement Conditions)

The measurement is performed by sandwiching a bundle of 40 fibers for artificial hair that are arranged at a heating rate of 4° C./min and a frequency of 1 Hz.

In addition, according to the present invention, there is provided a head accessory product using the fiber for artificial hair.

Advantageous Effects of Invention

According to the present invention, it is possible to provide a technique in relation to a fiber for artificial hair that exhibits a good tactile sensation and an appearance in which glare is suppressed in a well-balanced manner.

BRIEF DESCRIPTION OF THE DRAWINGS

The objective, and other objectives, characteristics, and advantages will be further clarified by preferred embodiments described below and the accompanying drawings below.

FIG. 1(*a*) is a schematic cross-sectional view in a case where a cross-sectional shape of a fiber for artificial hair is a spectacle shape. FIG. 1(*b*) is a schematic cross-sectional view in a case where a cross-sectional shape of the fiber for artificial hair is a Y-shape.

DESCRIPTION OF EMBODIMENTS

Hereinafter, embodiments of the present invention will be described in detail.

(Fiber for Artificial Hair)

A fiber for artificial hair according to an embodiment is formed of a polyvinyl chloride-based resin composition. The polyvinyl chloride-based resin composition preferably contains a non-crosslinked polyvinyl chloride-based resin (A) (hereinafter, simply referred to as a polyvinyl chloride-based resin (A)) and a crosslinked polyvinyl chloride-based resin (B).

The polyvinyl chloride-based resin (A) is not particularly limited, and a homopolymer resin which is a known homopolymer of vinyl chloride in the related art or various known copolymer resins in the related art can be used. Typical examples of the copolymer resin include a copolymer resin of vinyl chloride such as vinyl chloride-vinyl acetate copolymer resin and vinyl chloride-vinyl propionate copolymer resin and vinyl esters; copolymer resin of vinyl chloride such as vinyl chloride-butyl acrylate copolymer resin and vinyl chloride-acrylic acid 2 ethylhexyl copolymer resin and acrylic acid esters; copolymer resin of vinyl chloride such as vinyl chloride-ethylene copolymer resin and vinyl chloride-propylene copolymer resin and olefins; vinyl chloride-acrylonitrile copolymer resin; and the like. Preferred polyvinyl chloride-based resin (A) includes a homopolymer resin which is a homopolymer of vinyl chloride, a vinyl chloride-ethylene copolymer resin, a vinyl chloride-vinyl acetate copolymer resin, and the like. In the copolymer resin, the content of the comonomer is not particularly limited, and can be determined according to the moldability into a fiber, characteristics of the fiber, and the like.

A lower limit of the viscosity average degree of polymerization of the polyvinyl chloride-based resin (A) is preferably 450 or more, more preferably 500 or more, and further more preferably 550 or more. An upper limit of the viscosity average degree of polymerization of the polyvinyl chloride-based resin (A) is preferably 1,700 or less, more preferably 1,650 or less, and further more preferably 1,600 or less. By setting the viscosity average degree of polymerization of the polyvinyl chloride-based resin (A) to 450 or more, the entanglement of the polyvinyl chloride-based resin (A) can be increased and the strength can be increased. In addition, by setting the viscosity average degree of polymerization of the polyvinyl chloride-based resin (A) to 1,700 or less, appropriate gelation occurs, the fiber is less likely to be cut, and the productivity can be improved. In a case where a homopolymer resin of polyvinyl chloride is used as the polyvinyl chloride-based resin (A), the viscosity average degree of polymerization is preferably in a range of 650 or more and 1,450 or less in terms of achieving moldability and fiber characteristics. In a case where a copolymer is used as the polyvinyl chloride-based resin (A), the viscosity average degree of polymerization is preferably in a range of 1,000 or more and 1,700 or less, although it depends on the content of the comonomer.

The viscosity average degree of polymerization is obtained by dissolving 200 mg of polyvinyl chloride-based resin (A) in 50 mL of nitrobenzene, measuring a specific viscosity of the obtained polymer solution in a constant temperature bath at 30° C. using an Ubbelohde viscometer, and performing calculation according to JIS-K6721.

The polyvinyl chloride-based resin (A) can be produced by emulsion polymerization, bulk polymerization, suspension polymerization, and the like. A polymer produced by suspension polymerization is preferable in consideration of the initial colorability of the fiber and the like.

(Crosslinked Polyvinyl Chloride-Based Resin (B))

The crosslinked polyvinyl chloride-based resin (B) can be easily obtained by adding a polyfunctional monomer and polymerizing vinyl chloride in an aqueous medium during suspension polymerization, microsuspension polymerization, or emulsion polymerization. At this time, as the polyfunctional monomer used, a diacrylate compound such as polyethylene glycol diacrylate and bisphenol A modified diacrylate is particularly preferable.

The crosslinked polyvinyl chloride-based resin (B) is a mixture of a gel component having a crosslinked structure and containing vinyl chloride insoluble in tetrahydrofuran (THF) as a main component, and a polyvinyl chloride component soluble in tetrahydrofuran.

In the crosslinked polyvinyl chloride-based resin (B), the lower limit of the viscosity average degree of polymerization of the component dissolved in tetrahydrofuran is preferably 500 or more, more preferably 550 or more, and further more preferably 600 or more. The upper limit of the viscosity average degree of polymerization is preferably 2, 300 or less, more preferably 2, 200 or less, and further more preferably 2,100 or less.

By setting the viscosity average degree of polymerization of the component dissolved in tetrahydrofuran to 500 or more, the braidability of the obtained fiber for artificial hair can be made sufficient. On the other hand, by setting the viscosity average degree of polymerization to 2,300 or less, it is possible to suppress the occurrence of yarn breakage during spinning.

The viscosity average degree of polymerization of the component dissolved in tetrahydrofuran of the crosslinked polyvinyl chloride-based resin (B) is measured as follows.

1 g of the crosslinked polyvinyl chloride-based resin (B) is added to 60 mL of tetrahydrofuran and allowed to stand for about 24 hours. Then, the crosslinked polyvinyl chloride-based resin (B) is sufficiently dissolved using an ultrasonic cleaner. Next, the obtained tetrahydrofuran solution is subjected to an ultracentrifuge (30,000 rpm for 1 hour) to separate the insoluble matter in the tetrahydrofuran solution, and the supernatant tetrahydrofuran solvent is collected. Then, the tetrahydrofuran solvent is volatilized, and the viscosity average degree of polymerization of the remaining resin component is measured in the same manner as in the above-mentioned polyvinyl chloride-based resin (A).

The lower limit of the content of the crosslinked polyvinyl chloride-based resin (B) with respect to 100 parts by mass of the polyvinyl chloride-based resin (A) is preferably 2 parts by mass or more, more preferably 3 parts by mass or more, and further more preferably 4 parts by mass or more. In addition, the upper limit of the content of the crosslinked polyvinyl chloride-based resin (B) with respect to 100 parts by mass of the polyvinyl chloride resin (A) is preferably 15 parts by mass or less, more preferably 12 parts by mass or less, and further more preferably 10 parts by mass or less.

By setting the lower limit of the content of the crosslinked polyvinyl chloride-based resin (B) to the above range, it is possible to suppress glare of the obtained fiber for artificial hair and to improve the tactile sensation. In addition, by setting the upper limit of the content of the crosslinked polyvinyl chloride-based resin (B) to the above range, it is possible to suppress the glare of the obtained fiber for artificial hair, to improve the tactile sensation, and to obtain sufficient spinnability.

(Index Obtained by Dynamic Viscoelasticity Measurement)

In the fiber for artificial hair of the present embodiment, when the dynamic viscoelasticity measurement is performed under the following conditions, the lower limit of the value X1 of the loss tangent tan δ at 70° C. is 0.060 or more, preferably 0.065 or more, and furthermore preferably 0.70 or more. The upper limit of X1 is 0.120 or less, preferably 0.115 or less, and more preferably 0.110 or less.

In addition, when the dynamic viscoelasticity measurement is performed under the following conditions, the fiber for artificial hair of the present embodiment has a peak of loss tangent tan δ in a temperature range of 90° C. or higher and 110° C. or lower.

By setting the value X1 of the loss tangent tan δ at 70° C. to the above range while the loss tangent tan δ has a peak in the temperature range of 90° C. or higher and 110° C. or lower, it is possible to suppress the glare of the obtained fiber for artificial hair and to improve the tactile sensation.

(Dynamic Viscoelasticity Measurement Conditions)

The measurement is performed by sandwiching a bundle of 40 fibers for artificial hair that are arranged at a heating rate of 4° C./min and a frequency of 1 Hz, and in a range of 25° C. or higher and 170° C. or lower.

In addition, in the fiber for artificial hair of the present embodiment, when the dynamic viscoelasticity measurement is performed under the above conditions, the lower limit of the value X2 of the loss tangent tan δ at 60° C. is preferably 0.050 or more, more preferably 0.055 or more, and further more preferably 0.060 or more. The upper limit of X2 is preferably 0.100 or less, more preferably 0.095 or less, and further more preferably 0.090 or less.

By setting the value X2 of the loss tangent tan δ at 60° C. to the above range, it is possible to stabilize the characteristics of the fiber for artificial hair, to further suppress the glare of the obtained fiber for artificial hair, and to further improve the tactile sensation.

In addition, the fiber for artificial hair of the present embodiment preferably has a subpeak of the loss tangent tan δ obtained by the above-mentioned dynamic viscoelasticity measurement in a range of 50° C. or higher and lower than 80° C. According to this, it is possible to further suppress the glare of the obtained fiber for artificial hair, and to further improve the tactile sensation.

(Additive)

The polyvinyl chloride-based resin composition may contain an antistatic agent, a heat stabilizer, and a lubricant, if necessary.

(Antistatic Agent)

As the antistatic agent, nonionic, cationic, anionic, and amphoteric agents can be used. The content of the antistatic agent is preferably 0.01 part by mass or more and 1 part by mass or less with respect to 100 parts by mass in total of the polyvinyl chloride-based resin (A) and the crosslinked polyvinyl chloride-based resin (B). By setting the content of the antistatic agent to 0.01 parts by mass or more, it is possible to prevent the generation of static electricity. As a result, it is possible to prevent a problem likely to occur due to the generation of static electricity that the yarn is difficult to be bundled, and the yarn is easily entangled in the winding process, resulting in yarn breakage. In addition, by setting the content of the antistatic agent to 1 part by mass or less, it can be economically advantageous.

(Heat Stabilizer)

As the heat stabilizer, known ones in the related art can be used. Among these, one or two or more types selected from Ca—Zn-based heat stabilizer, hydrotalcite-based heat stabilizer, tin-based heat stabilizer, zeolite-based heat stabilizer, epoxy-based heat stabilizer, and β-diketone-based heat stabilizer can be desirably used. The heat stabilizer is used to improve thermal decomposition, long-running property, and filament color tone during molding, and a combination of a Ca—Zn-based heat stabilizer and a hydrotalcite-based heat stabilizer, having an excellent balance between moldability and thread characteristics is particularly preferable.

Examples of the Ca—Zn-based heat stabilizer include zinc stearate, calcium stearate, zinc 12-hydroxystearate, calcium 12-hydroxystearate, and the like. Examples of the hydrotalcite-based heat stabilizer include ALCAMIZER manufactured by Kyowa Chemical Industry Co., Ltd. and the like. Examples of the tin-based heat stabilizer include mercapto tin-based heat stabilizer such as dimethyl tin mercapto, dimethyl tin mercaptide, dibutyl tin mercapto, dioctyl tin mercapto, dioctyl tin mercapto polymer, and dioctyl tin mercaptoacetate, maleate tin-based heat stabilizer such as dimethyl tin maleate, dibutyl tin maleate, dioctyl tin maleate, and dioctyl tin maleate polymer, and laurate tin-based heat stabilizer such as dimethyl tin laurate, dibutyl tin laurate, and dioctyl tin laurate. Examples of the epoxy-based heat stabilizer include epoxidized soybean oil and epoxidized linseed oil. Examples of the β-diketone-based heat stabilizer include stearoylbenzoylmethane (SBM), dibenzoylmethane (DBM), and the like.

The hydrotalcite-based heat stabilizer is specifically a hydrotalcite compound, and examples thereof include a composite salt compound formed of magnesium and/or an alkali metal and aluminum or zinc, a composite salt compound formed of magnesium and aluminum, and the like. In addition, the water of crystallization may be dehydrated. In addition, the hydrotalcite compound may be a natural product or a synthetic product, and the synthetic product may be synthesized by a known method in the related art.

The content of the heat stabilizer is preferably 0.1 part by mass or more and 5.0 parts by mass or less with respect to 100 parts by mass in total of the polyvinyl chloride-based resin (A) and the crosslinked polyvinyl chloride-based resin (B). By setting the content of the heat stabilizer to 0.1 parts by mass or more, it is possible to prevent the resin composition from being thermally deteriorated and yellowing. In addition, by setting the content of the heat stabilizer to 5.0 parts by mass or less, it can be economically advantageous.

(Lubricant)

As the lubricant, known lubricants in the related art can be used, but at least one type selected from the group consisting of metal soap-based lubricant, polyethylene-based lubricant, higher fatty acid-based lubricant, higher alcohol-based lubricant, and ester-based lubricant is particularly preferable. The lubricant can reduce friction with a metal surface of the processing machine and friction between resins, improve fluidity, and improve processability.

Examples of the metal soap-based lubricant include metal soaps such as stearates, laurate, palmitate, and oleate of, for example, Na, Mg, Al, Ca, and Ba. Examples of higher fatty acid-based lubricants include saturated fatty acids such as stearic acid, palmitic acid, myristic acid, lauric acid, and capric acid, unsaturated fatty acids such as oleic acid, and mixtures thereof. Examples of the higher alcohol-based lubricants include stearyl alcohol, palmityl alcohol, myristyl alcohol, lauryl alcohol, and oleyl alcohol. Examples of ester-based lubricants include ester-based lubricants formed of alcohol and fatty acid, pentaerithritol-based lubricants such as monoester, diester, triester, tetraester of pentaerithritol or dipentaerithritol and higher fatty acid, or a mixture thereof, and montanate wax-based lubricants of esters of montanic acid and higher alcohol such as stearyl alcohol, palmityl alcohol, myristyl alcohol, lauryl alcohol, oleyl alcohol, and the like.

The content of the lubricant is preferably 0.2 parts by mass or more and 5.0 parts by mass or less with respect to 100 parts by mass in total of the polyvinyl chloride-based resin (A) and the crosslinked polyvinyl chloride-based resin (B). By setting the content of the lubricant to 0.2 parts by mass or more, it is possible to prevent the fluidity from deteriorating and prevent the processability from deteriorating. In addition, by setting the content of the lubricant to 5.0 parts by mass or less, it is possible to prevent the friction with the metal surface of the processing machine from being reduced and to stably extrude the resin.

In the present embodiment, other known blending agents in the related art used in the polyvinyl chloride-based resin composition can be added within a range not impairing the effects of the present invention, if necessary. Examples of the blending agent include processing aids, plasticizers, strengthening agents, ultraviolet absorbers, antioxidants, fillers, flame retardants, pigments, initial color improvers, conductivity-imparting agents, fragrances, and the like.

(Cross-Sectional Shape of Fiber for Artificial Hair)

The fiber for artificial hair preferably has a substantially uniform cross-sectional shape over a length direction. The cross section of the fiber for artificial hair preferably has a shape selected from the group consisting of polygons, spectacles, Y-shapes, and stars from a viewpoint of further suppressing the glare of the obtained fiber for artificial hair and further improving the tactile sensation. In addition, from a viewpoint of reducing the surface area, suppressing the reflection of light, and more effectively suppressing the glare, it is more preferable to have a shape selected from the group consisting of polygons, spectacles, and Y-shapes.

As the polygon, a pentagon and an octagon are preferable.

FIG. 1(*a*) is a schematic cross-sectional view in a case where the cross-sectional shape of a fiber for artificial hair 10 is a spectacles shape. FIG. 1(*b*) is a schematic cross-sectional view of the fiber for artificial hair 10 in a case where the cross-sectional shape is a Y-shape. As shown in FIG. 1(*a*), in a case where the cross-sectional shape of the fiber for artificial hair 10 is a spectacles shape, the fiber for artificial hair 10 has two circular or elliptical regions 1 and 2 and a connecting region 3 connecting the regions 1 and 2. As shown in FIG. 1(*b*), the Y-shaped cross-sectional shape has a protrusion 21, a protrusion 22, and a protrusion 23 protruding from a center C in three directions. A length L1 of the protrusion 21 in the protruding direction (the length from the center C to a tip of the protrusion 21), a length L2 of the protrusion 22 in the protruding direction (the length from the center C to a tip of the protrusion 22), a length L3 of the protrusion 23 in the protruding direction (the length from the center C to a tip of the protrusion 23) may be the same, but the length of any one protrusion may be longer than the length of the other two protrusions. In addition, the lengths of the three protrusions may be different from each other.

A fiber bundle for artificial hair in which a plurality of fibers for artificial hair are bundled may include fibers for artificial hair having two or more types of cross-sectional shapes among the above-mentioned cross-sectional shapes. The length L1, the length L2, and the length L3 are preferably in a range of 50 μm or more and 90 μm or less in terms of spinnability.

(Method for Producing Fiber for Artificial Hair)

A fiber for artificial hair is preferably produced by known melt spinning after mixing all the raw materials to make a pellet compound once.

(Mixing and Preparation of Pellets)

A polyvinylchloride-based resin (A) and a crosslinked polyvinyl chloride-based resin (B) are appropriately mixed with an antistatic agent, a heat stabilizer, a lubricant, and other blending agents in a predetermined ratio, are stirred and mixed with a known mixer in the related art, and then a pellet compound (pellet-shaped resin composition) is prepared by an extruder. For example, a powder compound (powdered resin composition) obtained by mixing using a Henschel mixer, a super mixer, a ribbon blender, and the like as a known mixer in the related art is melt-mixed to obtain a pellet compound.

A method for producing a powder compound may be hot blending or cold blending, and normal conditions can be used as the production conditions. Preferably, in order to reduce the volatile content in the composition, it is preferable to use a hot blend in which a cut temperature at a time of blending is raised to 105° C. or higher and 155° C. or lower.

The production of the pellet compound can be carried out in the same manner as the general method for producing a vinyl chloride-based pellet compound. For example, it is possible to obtain a pellet compound using a kneader such as a single shaft extruder, a twin shaft extruder in a different direction, a conical twin shaft extruder, a twin shaft extruder in the same direction, a co-kneader, a planetary gear extruder, and a roll kneader. Conditions at a time of producing the pellet compound are not particularly limited, but it is preferable to set the resin temperature to 185° C. or lower in order to prevent thermal deterioration of the polyvinyl chloride-based resin composition. In addition, it is also possible to install a mesh near a tip of a screw to remove metal pieces of the screw and fibers attached to protective gloves that may be mixed in a small amount in the pellet compound. A cold cut method can be adopted for the production of pellets. Means for removing chips (fine powder generated during pellet production) that may be mixed during cold cutting may be adopted. In addition, if the cutter is used for a long time, the cutter may get nicked and chips are likely to be generated. Therefore, it is preferable to replace the cutter as appropriate.

(Spinning)

Using the pellets obtained as described above, the resin is extruded under conditions of good spinnability in a cylinder temperature of 150° C. or higher and 190° C. or lower and a nozzle temperature of 180±15° C. using a nozzle having protrusions on three sides to be melt-spun. The cross-sectional shape of a nozzle is set so that the cross-sectional shape of the obtained fiber for artificial hair has a desired shape.

An undrawn yarn (fiber of the polyvinyl chloride-based resin composition) melt-spun from the nozzle is introduced into a heating cylinder (heating cylinder temperature of 250° C.), heat-treated instantaneously, and is wound by a take-up machine installed at a position about 4.5 m immediately below the nozzle. The strand remains an undrawn yarn. At the time of this winding, the take-up speed is adjusted so that the fineness of the undrawn yarn is 175 denier or more and 185 denier or less.

When the polyvinyl chloride-based resin composition is made into an undrawn yarn, a known extruder in the related art can be used. For example, a single shaft extruder, a twin shaft extruder in a different direction, a conical twin shaft extruder, or the like can be used, but particularly preferably, a single-screw extruder having a diameter of 35 mm or more and 85 mm or less or a conical extruder having a diameter of 35 mmcp or more and 50 mmcp or less can be used. If the diameter is too large, the amount of extrusion is large, the nozzle pressure is too large, the temperature of the resin becomes high, and deterioration is likely to occur in some cases.

(Drawing and Heat Treatment)

Subsequently, the undrawn yarn is drawn to three times in a drawing machine (for example, 105° C. in an air atmosphere), and then heat-treated in a heat treatment machine (for example, 120° C. in an air atmosphere) so as to be 0.75 times, for example, (heat-shrunk until the total length of the fiber is shrunk up to 75% of the length before treatment) so that the fineness is 58 denier or more and 62 denier or less to prepare a fiber for artificial hair.

(Gear Processing)

The fiber for artificial hair may be gear-processed, if necessary. Gear processing is a method of performing crimping by passing a fiber bundle between two meshing high-temperature gears, and the material of the gear to be used, the shape of the wave of the gear, the number of gear teeth, and the like are not particularly limited. The wave shape of the crimp can change depending on the fiber material, fineness, pressure conditions between gears, and the like, but in the present embodiment, the wave shape of the crimp can be controlled by a depth of a groove of the gear waveform, a surface temperature of the gear, and a processing speed. These processing conditions are not particularly limited, but preferably, the depth of the groove of the gear waveform is 0.2 mm or more and 6 mm or less, more preferably 0.5 mm or more and 5 mm or less, the surface temperature of the gear is 30° C. or higher and 100° C. or lower, more preferably 40° C. or higher and 80° C. or lower, and the processing speed is 0.5 m/min or more and 10 m/min or less, more preferably 1.0 m/min or more and 8.0 m/min or less.

The total fineness of the fiber bundle during gear processing is not particularly limited, but is 100,000 decitex or more and 2 million decitex or less, and more preferably 500,000 decitex or more and 1.5 million decitex or less. By setting the total fineness of the fiber bundle to 100,000 decitex or more, it is possible to increase the productivity of gear processing and to further suppress the occurrence of yarn breakage during gear crimp processing. On the other hand, by setting the total fineness of the fiber bundle to 2 million decitex or less, it is possible to obtain a more uniform wave shape.

The fiber for artificial hair according to the embodiment described above can exhibit a good tactile sensation and an appearance in which glare is suppressed in a well-balanced manner.

In the present embodiment, by appropriately adjusting the type and blending ratio of each component contained in the fiber for artificial hair, and the preparation method of the polyvinyl chloride-based resin (A) and the crosslinked polyvinyl chloride-based resin (B), it is possible to obtain a fiber for artificial hair satisfying the above-mentioned parameters. In addition, by selecting a cross-sectional shape of the fiber for artificial hair from the above-mentioned shapes, it is possible to satisfy the above-mentioned parameters.

(Head Accessory Product)

The fiber for artificial hair according to the embodiment can be used for a head accessory product. Examples of the head accessory product include wigs, hairpieces, blades, and extension hair. The head accessory product obtained from the fiber for artificial hair according to the embodiment exhibits an effect close to that of human hair.

Although the embodiments of the present invention have been described above, these are examples of the present invention, and various configurations other than the above can be adopted.

EXAMPLES

Hereinafter, the present invention will be described with reference to examples and comparative examples, but the present invention is not limited thereto.

Table 1 shows components and blending amounts used for producing the fibers for artificial hair of each example and each comparative example.

The details of the components shown in Table 1 are as follows.

Vinyl chloride resin: homopolymer of vinyl chloride, viscosity average degree of polymerization of 500 (manufactured by Taiyo Vinyl Corporation, TH-1000)

The viscosity average degree of polymerization was calculated according to JIS-K6721 by dissolving 200 mg of vinyl chloride in 50 mL of nitrobenzene, and measuring a specific viscosity of this polymer solution in a constant temperature bath at 30° C. using an Ubbelohde viscometer.

Crosslinked polyvinyl chloride resin: partially crosslinked polyvinyl chloride resin, THF-soluble matter viscosity average degree of polymerization 1600 (manufactured by Shin-Etsu Chemical Co., Ltd., GR-1300T)

The viscosity average degree of polymerization of the soluble matter of tetrahydrofuran (THF) was measured as follows. 1 g of the crosslinked polyvinyl chloride resin was added to 60 mL of tetrahydrofuran and allowed to stand for about 24 hours. Then, the resin was dissolved using an ultrasonic cleaner. The insoluble matter in the THF solution was separated using an ultracentrifuge (30,000 rpm×1 hour), and a THF solvent of the supernatant was collected. Then, the THF solvent was volatilized, and the viscosity average degree of polymerization was measured by the same method as that of the polyvinyl chloride-based resin (A).

Antistatic agent: manufactured by NOF CORPORATION, New Elegance ASK

Heat stabilizer: manufactured by Nissan Chemical Industries, Ltd., CP-410A

Lubricant: manufactured by RIKEN Vitamin Co., Ltd, EW-100

Example 1

The vinyl chloride-based resin composition according to the component and blending amounts shown in Table 1 are mixed with a ribbon blender, and melt-kneaded using an extruder having a diameter of 40 mm in a cylinder temperature range of 130° C. or higher and 170° C. or lower to produce pellets.

Using a nozzle having 120 holes of spectacles shape, the pellets were melt-spun with an extruder having a diameter of 30 mm at the amount of extrusion of 10 kg/hour in a cylinder temperature of 140° C. or higher and 190° C. or lower and a nozzle temperature range of 180±15° C.

Then, the pellets were heat-treated in a heating cylinder (atmosphere of 200° C. or higher and 300° C. or lower) provided immediately below the nozzle for about 0.5 seconds or more and 1.5 seconds or less to obtain 150 decitex fibers. Subsequently, sequentially through a step of drawing the melt-spun fiber to 300% in an air atmosphere of 100° C. and a step of heat-shrinking the drawn fiber until the total length of the drawn fiber is shrunk to 75% of the length before the treatment in an air atmosphere of 120° C., a fiber for artificial hair of 67 decitex of Example 1 was obtained.

Examples 2, 3, and 6, and Comparative Examples 1 and 2

Fibers for artificial hair of Examples 2, 3, and 6 and Comparative Examples 1 and 2 were prepared in the same procedure as in Example 1 except that the vinyl chloride-based resin composition having the components and blending amounts shown in Table 1 was used.

Example 4

A fiber for artificial hair of Example 4 was prepared in the same procedure as in Example 1 except that melt spinning was performed using a vinyl chloride-based resin composition having the components and the blending amounts shown in Table 1 and using an extruder having pentagonal holes.

Example 5

The fiber for artificial hair of Example 5 was prepared in the same procedure as in Example 1 except that melt spinning was performed using a vinyl chloride-based resin composition having the components and blending amounts shown in Table 1 using an extruder having Y-shaped holes.

Example 7

A fiber for artificial hair of Example 7 was prepared in the same procedure as in Example 1 except that melt spinning was performed using a vinyl chloride-based resin composition having the components and blending amounts shown in Table 1 and using an extruder having star-shaped holes.

(Cross-Sectional Shape Observation)

The cross section of the obtained fiber for artificial hair was observed using a digital microscope manufactured by KEYENCE, VHX-500, and the cross-sectional shape of the fiber for artificial hair was classified. Table 1 shows the observation results of the cross-sectional shape of each fiber for artificial hair.

(Dynamic Viscoelasticity Measurement Conditions)

Using DMS6100 manufactured by SII Nanotechnology and setting the heating rate to 4° C./min, the frequency to 1 Hz, and the distance between chucks to 3 mm, a bundle of 40 fibers for artificial hair were sandwiched, the loss tangent tan δ was measured in a range of 25° C. or higher and 170° C. or lower, values of the loss tangent tan δ at 60° C. and 70° C. were obtained, and the presence or absence of the peak of the loss tangent tan δ in a range of 90° C. or higher and 110° C. or lower was examined. The obtained results are shown in Table 1.

(Tactile Sensation)

Softness, suppleness, and moderate elasticity (tactile sensation) when gently gripping a bundle of about 20,000 fibers for artificial hair, and good finger passage (smoothness) when a finger is passed through a bundle of fibers for artificial hair were evaluated. Specifically, five treatment technicians of fiber for artificial hair performed evaluation according to the following evaluation criteria and performed determination.

Evaluation Criteria

A case where 90% or more of the technicians evaluated that the touch was very smooth and the tactile sensation was particularly good was rated as "A", a case where 70% or more and less than 90% of the technicians evaluated that the smoothness was slightly inferior but the tactile sensation was good was rated as "B", and a case where less than 70% of the technicians evaluated that the touch was not smooth and the tactile sensation was not good was rated as "C". The evaluation results are shown in Table 1.

(Glare)

Light (sunlight) was applied to a bundle of about 20,000 fibers for artificial hair, and the excessive glare received from bright spots caused by the reflection of light was evaluated. Five treatment technicians of fiber for artificial hair performed evaluation according to the following evaluation criteria and performed determination.

Evaluation Criteria

A case where 90% or more of the technicians evaluated that there was no glare, there was natural luster, and the appearance was particularly good was rated as "A", a case where 70% or more and less than 90% of the technicians evaluated that there was some glare but the appearance was not noticeable was rated as "B", and a case where less than 70% of the technicians evaluated that there was glare, there was unnatural sensation, and there was visually unpleasant sensation was rated as "C". Table 1 shows the evaluation results for glare.

TABLE 1

| | | | Example 1 | Example 2 | Example 3 | Example 4 | Example 5 | Example 6 | Example 7 | Comparative Example 1 | Comparative Example 2 |
|---|---|---|---|---|---|---|---|---|---|---|---|
| Components | Polyvinyl chloride-based resin | Parts by mass | 100 | 100 | 100 | 100 | 100 | 100 | 100 | 100 | 100 |
| | Crosslinked polyvinyl chloride-based resin | | 5 | 1 | 13 | 5 | 5 | 20 | 5 | 0 | 25 |
| | Antistatic agent | | 0.03 | 0.03 | 0.03 | 0.03 | 0.03 | 0.03 | 0.03 | 0.03 | 0.03 |
| | Heat stabilizer | | 3 | 3 | 3 | 3 | 3 | 3 | 3 | 3 | 3 |
| | Lubricant | | 0.5 | 0.5 | 0.5 | 0.5 | 0.5 | 0.5 | 0.5 | 0.5 | 0.5 |
| Evaluation results | Cross-sectional shape | | Spectacles shape | Spectacles shape | Spectacles shape | Pentagon | Y-shape | Spectacles shape | Star-shape | Spectacles shape | Spectacles shape |
| | tanδ at 60° C. | | 0.076 | 0.040 | 0.105 | 0.074 | 0.073 | 0.085 | 0.075 | 0.033 | 0.12 |
| | tanδ at 70° C. | | 0.097 | 0.065 | 0.110 | 0.095 | 0.093 | 0.110 | 0.095 | 0.048 | 0.14 |
| | Presence or absence of peak in a range of 90° C. or higher and 110° C. or lower | | Present | Present | Present | Present | Present | Present | Present | Present | Present |
| | Tactile sensation | | A | A | B | A | A | B | A | A | C |
| | Glare | | A | B | A | A | A | A | B | C | A |

As shown in Table 1, it was confirmed that the fibers for artificial hair of Examples 1 to 7 exhibited a good tactile sensation and a good appearance with suppressed glare. Among these, the fibers for artificial hair of Examples 1, 4, and 5 obtained particularly good results in terms of both tactile sensation and glare.

On the other hand, in Comparative Example 1, the glare was not good, and in Comparative Example 2, the tactile sensation was poor.

Priority is claimed on Japanese Patent Application No. 2018-224036, filed on Nov. 29, 2018, the content of which is incorporated herein by reference.

The invention claimed is:

1. A fiber bundle for artificial hair formed of a polyvinyl chloride-based resin composition, wherein the polyvinyl chloride-based resin composition includes a non-crosslinked polyvinyl chloride-based resin and a crosslinked polyvinyl chloride-based resin, a content of the crosslinked polyvinyl chloride-based resin with respect to 100 parts by mass of the non-crosslinked polyvinyl chloride-based resin is 4 parts by mass or more and 10 parts by mass or less, in the crosslinked polyvinyl chloride-based resin, a viscosity average degree of polymerization of a component dissolved in tetrahydrofuran is 1,600 or more and 2,300 or less, a cross section of the fiber for artificial hair has a shape of a polygon, and when dynamic viscoelasticity is measured under the following conditions (i), the fiber for artificial hair has a value X1 of a loss tangent tan δ at 70° C. of 0.06 or more and 0.12 or less, and has a peak in a temperature range of 90° C. or higher and 110° C. or lower, (dynamic viscoelasticity measurement conditions (i))

the measurement is performed by sandwiching a bundle of 40 fibers for artificial hair that are arranged at a heating rate of 4° C./min and a frequency of 1 Hz.

2. The fiber bundle for artificial hair according to claim 1, wherein a value X2 of a loss tangent tan δ at 60° C. obtained by the dynamic viscoelasticity measurement under the conditions (i) is 0.05 or more and 0.10 or less.

3. The fiber bundle for artificial hair according to claim 1, wherein the non-crosslinked polyvinyl chloride-based resin has a viscosity average degree of polymerization of 450 or more and 1,700 or less.

4. A head accessory product using the fiber bundle for artificial hair according to claim 1.

5. A head accessory product using the fiber bundle for artificial hair according to claim 2.

6. The fiber bundle for artificial hair according to claim 1, wherein the polygon is a pentagon or an octagon.

* * * * *